US005160196A

United States Patent [19]

Curtis

[11] Patent Number: 5,160,196

[45] Date of Patent: Nov. 3, 1992

[54] TRASH BAG WITH MOUTH STIFFENER INSERT

[76] Inventor: Joseph Curtis, 421 15th Ave., North, Surfside Beach, S.C. 29577

[21] Appl. No.: 655,851

[22] Filed: Feb. 15, 1991

[51] Int. Cl.[5] ..... B65D 33/28; B65D 33/30

[52] U.S. Cl. ..... 383/33; 383/43; 383/71; 383/76

[58] Field of Search ..... 383/33, 43, 71, 72, 383/73, 74, 75, 76

[56] References Cited

U.S. PATENT DOCUMENTS

| | | | |
|---|---|---|---|
| 1,228,333 | 5/1917 | McBurney . | |
| 1,513,463 | 10/1924 | Kidder | 383/76 X |
| 1,586,147 | 5/1926 | Flory | 383/76 X |
| 1,737,065 | 11/1929 | Thornton | 383/76 X |
| 1,897,018 | 2/1933 | Draheim | 383/71 X |
| 2,284,212 | 5/1942 | Kanzow | 383/43 X |
| 2,295,584 | 9/1942 | Larson . | |
| 2,527,746 | 10/1950 | Lawrence . | |
| 2,654,892 | 10/1953 | Szabo | 383/33 X |
| 3,817,434 | 6/1974 | Dickman . | |
| 3,893,649 | 7/1975 | Cornell et al. . | |
| 3,920,180 | 11/1975 | Meier | 383/76 X |
| 3,958,785 | 5/1976 | Aboud . | |
| 4,026,340 | 5/1977 | Sobolik . | |
| 4,050,492 | 9/1977 | Veilleux | 383/71 X |
| 4,287,701 | 9/1981 | Washington . | |
| 4,317,478 | 3/1982 | Babbige | 383/43 |
| 4,482,116 | 11/1984 | Vadnais . | |
| 4,775,123 | 10/1988 | Borland et al. . | |
| 4,785,960 | 11/1988 | Belisle | 383/75 X |
| 4,979,833 | 12/1990 | Cook | 383/74 X |

FOREIGN PATENT DOCUMENTS

| | | | |
|---|---|---|---|
| 464743 | 3/1914 | France | 383/71 |
| 1329631 | 5/1963 | France | 383/71 |
| 2640943 | 6/1990 | France | 383/33 |

*Primary Examiner*—Stephen Marcus
*Assistant Examiner*—Jes F. Pascua

[57] ABSTRACT

A large plastic lawn or trash bag is provided including a tubular hem extending about its open end. An access opening is formed at one point about the hem opening thereinto and a plurality of pairs of registered openings are formed through the bag and the material defining the free marginal edge of the hem along the path the free marginal portion of the hem is secured to the bag. An elongated stiff but flexive reinforcing strip is provided of a length somewhat greater than the length of the periphery of the open end of the bag and the opposite ends of the strip are provided with coacting structure by which the opposite ends may be secured together in adjusted overlapped relation. The reinforcing strip may be inserted into the hem through the access openings thereof and have its opposite ends releasably secured together with the reinforcing strip serving to maintain the open end of the bag open or, alternatively, the strip may be threaded through the registered openings and thereafter have its ends removably secured together so as to function as a reinforcement strip to maintain the open end of the bag open. The reinforcing strip is arcuate in transverse cross section in order to increase the stiffness thereof when functioning as a reinforcing strip, but the arcuate strip is only appoximately 30 degrees in angular extent to enable the strip to be coiled into a coil of a diameter no more than one-tenth the length of the reinforcing strip to thereby enable the strip to be readily packaged within a package containing a plurality of folded bags with which the strip ultimately is to be used.

11 Claims, 1 Drawing Sheet

TRASH BAG WITH MOUTH STIFFENER INSERT

BACKGROUND OF THE INVENTION

1. Field of the Invention

This invention relates to a large lawn or trash bag constructed of flexible plastic material and including a first closed end and a second open end with the open end including a reversely turned portion secured to the bag along a path spaced from the free edge of the reversely turned portion to provide the open end of the bag with a tubular hem extending thereabout. One side of the hem is provided with an access opening and a plurality of pairs of registered openings are formed through the reversely turned portion of the bag open end and the portions of the bag over which the reversely turned portion is disposed, the pairs of registered openings being spaced about the periphery of the opened bag end. An elongated stiff, but flexible reinforcing strip is provided having opposite ends and structure at its opposite ends whereby they may be releasably secured together against longitudinal shifting relative to each other. The elongated strip may be lengthwise inserted into the tubular hem through the access opening, or threaded through the pairs of registered openings, and thereafter have the opposite ends thereof releasably secured together, the strip serving to reinforce the open end of the bag so that the latter will stand in an open position when the bag is disposed lengthwise on a horizontal surface.

2. Description of Related Art

Various different forms of bags having reinforced open ends or to be used in conjunction with attachments therefore for maintaining the open ends against collapsed heretofore have been provided. Examples of these previously known structures are disclosed in U.S. Pat. Nos. 1,228,333, 2,295,584, 2,527,746, 3,817,434, 3,893,649, 3,958,785, 4,026,340, 4,287,701, 4,482,116 and 4,775,123.

However, these various forms of bags and related stiffeners do not include the overall structural and operational features of the instant invention which enables a plurality of the bags of the instant invention to be marketed in the usual box therefore and with the box also receiving at least one bag stiffener disposed in a compact, coiled state for use in conjunction with the boxed bags upon their removal from the box.

SUMMARY OF THE INVENTION

The bag stiffener of the instant invention has been provided for use in conjunction with a specifically adapted bag mouth to enable a large trash or lawn debris bag to lie upon the ground with the mouth end of the bag reinforced into an open position.

Although the reinforced bag mouth is not capable of being supported in an upstanding position when the bag is empty due to the flexibility of the bag material, as soon as a first quantity of trash or lawn debris is placed into the bag to support at least a portion of the top wall thereof in an elevated position, the mouth of the bag will be maintained in an opened upstanding position.

The main object of this invention is to provide a trash or lawn debris bag with a reinforced mouth in order that the mouth may be maintained in an open position at least after an initial amount of trash or lawn debris has been placed into the bag.

A still further object of this invention, in accordance with the preceding object, is to provide a bag having a reinforced mouth constructed in a manner such that only one peripheral portion of the mouth end of the bag need be held in order to initially place trash or lawn debris in the bag.

A further object of this invention is to provide a bag having reinforcement for the mouth end thereof which may be operatively associated with the mouth end of the bag in alternate positions.

A still further object of this invention is to provide reinforcement for the mouth end of a flexible bag wherein the reinforcement is constructed in a manner such that it may be readily coiled into a compact state and packaged within a container for a plurality of appropriately modified bags, thereby enabling the reinforcement to be releasably engaged with successive bags removed from the container of bags.

A final object of this invention to be specifically enumerated herein is to provide a bag and reinforcement for the mouth end thereof which will conform to conventional forms of manufacture, be of simple construction and easy to use so as to provide a device that will economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
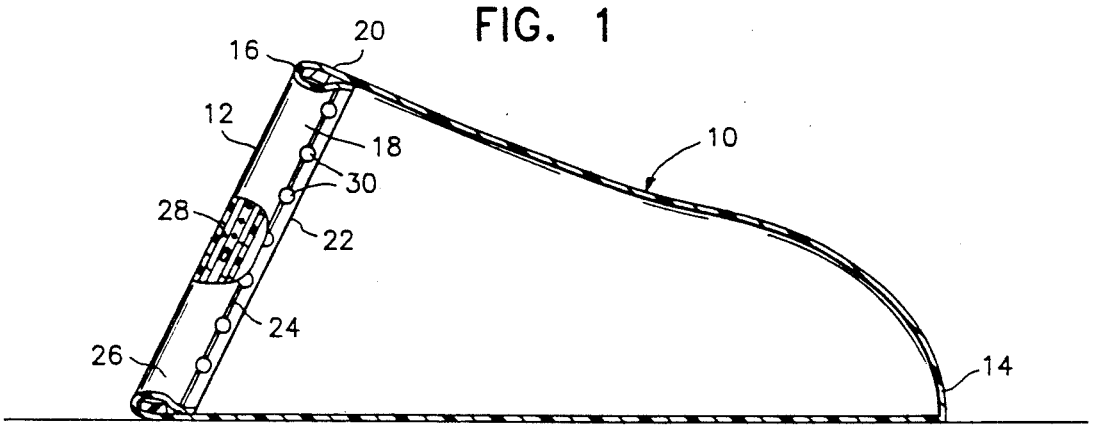
FIG. 1 is a longitudinal vertical sectional view of a bag having a reinforced mouth end constructed in accordance with the present invention and with the bag lying lengthwise upon a horizontal surface.

Referring now more specifically to the drawings the numeral 10 generally designates a conventional form of large trash or lawn debris bag constructed of flexible plastic and including an open mouth end 12 and a closed end 14 remote from the mouth end 12.

As is conventional with some trash bags presently being marketed, the open mouth end 12 of the bag 10 includes a reversely turned portion 16 defined between a terminal end band 18 of the open end of the bag 10 extending about the mouth end thereof and an opposing peripheral band 20 extending about the open end of the bag 10 spaced on the side of the reversely turned portion 16 remote from the band 18, the band 18 including a free edge 22.

The bands 18 and 20 are secured together by thermo welding (or other means) along a path 24 extending about the open end of the bag 10 as is conventional in order that the bands 1 and 20 and the reversely turned portion 16 may define a tubular hem 26 extending about the mouth end of bag 12, some conventional bags utilizing such a tubular hem to receive a flexible endless tie strip (not shown) therein to which access may be had by openings (not shown) formed in and spaced along the band 18.

The band 20 has one access opening 28 formed therein and the bands 18 and 20 have a plurality of pairs of registered openings 30 formed therein with the path 24 extending substantially diametrically through the openings 30.

An elongated reinforcing strip 32 is provided. The length of the strip 32 is somewhat greater than the circumferential extent of the open mouth end 12 of the bag 10 and includes first and second end portions 34 and 36. The end portion 36 is provided with a plurality of longitudinally spaced openings 38 formed therethrough and the terminal end thereof is rounded as at 40. The end portion 34 includes an arrowhead-shaped terminal end 42 integrally joined to an adjacent tapered portion 44 of the first end 34 and the arrowhead-shaped terminal end 42 is snugly receivable through a selected opening 38. In addition, the reinforcing strip 32 is arcuate in transverse cross section and includes an angular extent of approximately 30 degrees.

The access opening 28 may be formed either in the band 20 or the band 18, but placement of the access opening 28 in the band 20 facilitates the insertion of the reinforcing strip 32 into the tubular hem 36.

In operation, the bag 10 is removed from a receptacle (not shown) containing plurality of the bands 10 and the coiled reinforcing strip 32 also is removed from the receptacle. Then, either end of the reinforcing strip 32 may be lengthwise inserted into the tubular hem 26 through the opening 28 until the entire strip 32 has been received within the hem 26. Then, with the end portions 34 and 36 initially overlapped, the end portions 34 and 36 are shifted relative to each other until the band 32 presses tightly against the band 20. Thereafter, the arrowhead-shaped terminal end 42 of the end portion 34 is inserted in one of the openings 38. In this manner, the strip 32 reinforces the tubular hem 26 in a manner such that the open end of the bag 10 is maintained in a fully opened position when the upper portion of the mouth end 12 illustrated in FIG. 1 is manually supported. At this point, suitable trash and/or lawn debris may be initially introduced into the bag 10 through the mouth end 12 thereof.

As soon as the bag 10 has a quantity of trash or lawn debris initially introduced thereinto adjacent the open mouth end 12, the trash or debris will maintain the mouth end 12 in an upstanding position such as that illustrated in FIG. 1.

Figure 5:
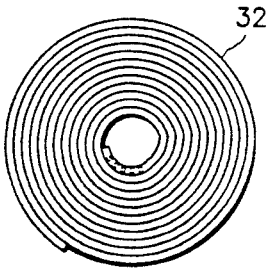
FIG. 5 is a plan view of the bag mouth reinforcement strip disposed in a tightly coiled state for storage within a container for a plurality of bags.

The arcuate transverse cross sectional shape of the strip 32 provides the strip 32 with more reinforcing capacity and yet still enables the strip 32 to be coiled in the manner illustrated in FIG. 5 with its convex side disposed outermost.

Figure 2:
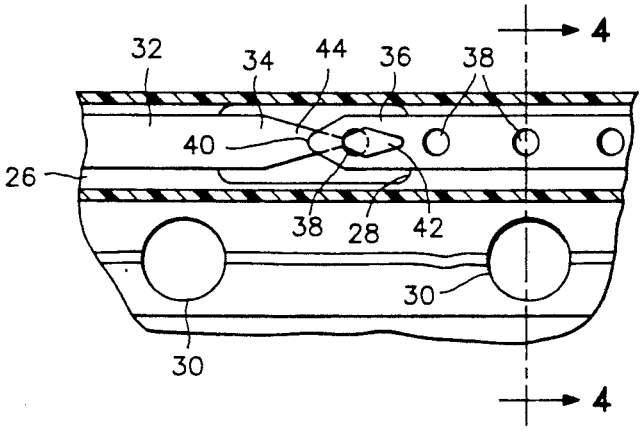
FIG. 2 is an enlarged fragmentary vertical sectional view of the mouth end of the bag and the associated reinforcement illustrating a first manner of engagement of the bag mouth reinforcement with the mouth end of the bag.

Alternately, either end 34 or 36 of the strip 32 may be threaded through the openings 30 until the full length of the strip 32 has been threaded through the openings 30 and the end portions 34 and 36 may then be engaged with each other in the manner illustrated in FIG. 2 of the drawings either on the inside of the bag 10 or in the outside thereof. By placing the openings 30 generally centered along the path 24, the path 24 along which the bands 18 and 20 are thermo welded together or otherwise secured together acts as reinforcement for the edges of the openings 30.

Figure 3:
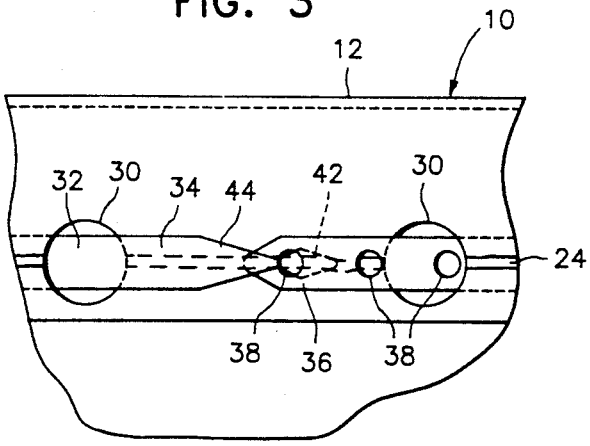
FIG. 3 is a fragmentary enlarged side elevational view of the mouth end of the bag illustrating an alternate manner of engagement of the reinforcing strip with the mouth end of the bag.
Figure 4:
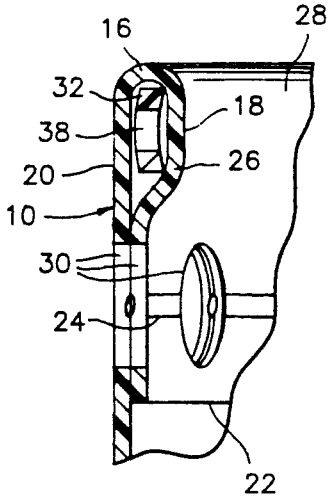
FIG. 4 is an enlarged fragmentary vertical sectional view taken substantially upon the plane indicated by the section line 4—4 of FIG. 2.

The reinforcing strip 32 functions substantially identically whether it is contained within the tubular hem 26 or threaded through the openings 30 in the manner illustrated in FIG. 3.

The reinforcing strip 32 is preferably constructed of plastic and is of sufficient stiffness to reinforce the mouth end 12 of the bag 10 as desired, particularly in view of the arcuate cross sectional shape of the strip 32, but the band 32 is sufficiently flexive to be rolled into the compact state thereof illustrated in FIG. 5 with the convex side of the strip disposed outermost. Further, the strip 30 is sufficiently flexive and thin to enable the strip 30 to be wound into a coil having a diameter not exceeding approximately one-tenth the length of the strip.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, a flexible plastic bag including a first closed end and a second open end, said bag, at said second end, defining a terminal end band extending about said second end and a peripheral band extending thereabout closely spaced from said terminal end band toward said closed end, said open end including a reversely turned portion intermediate said bands with the latter disposed in registered superposed relation, said bands being bonded together along a path disposed intermediate the free edge of said terminal end band and said reversely turned portion to define a tubular hem extending about said open end intermediate said path and said reversely turned portion, said bands having pairs of registered openings formed therein spaced about said open end, an elongated, stiff, but flexive reinforcing strip including joining means at its opposite ends releasably securing said ends together against longitudinal shifting relative to each other, said strip being lengthwise threaded through adjacent pairs of registered openings, said strip, when threaded through said registered openings and having said opposite ends secured together serving to reinforce said one end of said bag against collapse, said strip being generally arcuate in transverse cross section with its major radius of curvature side thereof disposed outermost.

2. The combination of claim 1 wherein the arc extent of said arcuate cross section is generally 30 degrees.

3. The combination of claim 1 wherein said strip is sufficiently flexive for said strip to be wound into a coil of a diameter not exceeding approximately one-tenth the length of said strip, to thereby enable said coiled strip to be readily packaged within a package containing a plurality of said bags.

4. In combination, a flexible plastic bag including a first closed end and a second open end, said bag, at said second end, defining a terminal end band extending about said second end and a peripheral band extending thereabout closely spaced from said terminal end band toward said closed end, said open end including a reversely turned portion intermediate said bands with the latter disposed in registered superposed relation, said bands being bonded together along a path disposed intermediate the free edge of said terminal end band and said reversely turned portion to define a tubular hem extending about said open end intermediate said path and said reversely turned portion, said bands having pairs of registered openings formed therein spaced about said open end, an elongated, stiff, but flexive reinforcing strip including joining means at its opposite ends releasably securing said ends together against longitudinal shifting relative to each other, said strip being lengthwise threaded through adjacent pairs of registered openings, said strip, when threaded through said registered openings and having said opposite ends secured together serving to reinforce said open end of said bag against collapse, said pairs of registered openings being generally centered along said path.

5. The combination of claim 4 wherein said strip is constructed of plastic.

6. The combination of claim 4 wherein one of said ends of said strip includes at least one latch opening formed therethrough spaced from the terminal end thereof and disposed generally on the longitudinal center line of said strip, the other of said strip ends including an arrowhead-shaped terminal end thereof releasably receivable through said latch opening.

7. The combination of claim 4 wherein said one end of said strip includes a plurality of latch openings formed therein spaced longitudinally of said strip.

8. The combination of claim 4 wherein said strip is generally arcuate in transverse cross section with its major radius of curvature side thereof disposed outermost.

9. The combination of claim 8 wherein said strip is sufficiently flexive for said strip to be wound into a coil of diameter not exceeding approximately one-tenth the length of said strips, to thereby enable said coiled strip to be readily packaged within a package containing a plurality of said bags in folded condition.

10. In combination, a flexible plastic bag including a first closed end and a second open end, said bag, at said second end, defining a terminal end band extending about said second end and a peripheral band extending thereabout closely spaced from said terminal end band toward said closed end, said open end including a reversely turned portion intermediate said bands with the latter disposed in registered superposed relation, said bands being bonded together along a path disposed intermediate the free edge of said terminal end band and said reversely turned portion to define a tubular hem extending about said open end intermediate said path and said reversely turned portion, said bands having pairs of registered openings formed therein spaced about said open end, an elongated, stiff, but flexive reinforcing strip including joining means at its opposite ends releasably securing said ends together against longitudinal shifting relative to each other, said strip being lengthwise threaded through adjacent pairs of registered openings, said strip, when threaded through said registered openings and having said opposite ends secured together serving to reinforce said open end of said bag against collapse, said strip being generally arcuate in transverse cross section with its major radius of curvature side thereof disposed outermost.

11. The combination of claim 10 wherein said strip is sufficiently flexive for said strip to be wound into a coil of a diameter not exceeding approximately one-tenth the length of said strip, to thereby enable said coiled strip to be readily packaged within a package containing a plurality of said bags in folded condition.

* * * * *